US006135131A

United States Patent [19]

Downing

[11] Patent Number: 6,135,131

[45] Date of Patent: Oct. 24, 2000

[54] ADJUSTABLE WALKER HANDLES

[75] Inventor: Fred Downing, White Bear Lake, Minn.

[73] Assignee: EZ Way Inc., Minneapolis, Minn.

[21] Appl. No.: 09/221,006

[22] Filed: Dec. 23, 1998

[51] Int. Cl.[7] ..... A61H 3/00

[52] U.S. Cl. ..... 135/67; 135/71

[58] Field of Search ..... 135/65, 67, 76, 135/71–73

[56] References Cited

U.S. PATENT DOCUMENTS

D. 322,049 12/1991 Doman et al. .
5,305,773 4/1994 Browning ..... 135/67
5,411,044 5/1995 Andolfi ..... 135/66
5,524,971 6/1996 Jay et al. .
5,556,168 9/1996 Dinsmoor, III et al. .
5,778,605 7/1998 Ellena et al. .
5,785,070 7/1998 Block ..... 135/67

*Primary Examiner*—Beth A. Stephan
*Attorney, Agent, or Firm*—Kinney & Lange, P.A.

[57] ABSTRACT

A device for use in cooperation with an apparatus for lifting a person from the seated position to a standing position wherein the apparatus has at least one hollow handle extending downwardly when the person is in a standing position. The device includes an extension portion for at least partial insertion within the hollow handle and an engaging mechanism for frictionally engaging an inner surface of the hollow handle and a handle portion extending outwardly from the extension portion for gripping by the person when in a standing position.

11 Claims, 4 Drawing Sheets

ADJUSTABLE WALKER HANDLES

BACKGROUND OF THE INVENTION

The present invention relates to the health care field. The present invention specifically relates to the lifting of individuals and aiding individuals in walking.

Personal lifting systems have greatly reduced injuries to individuals that are unable to rise from a seated or prone position. Prior to the use of personal lifting systems, individuals were lifted by health care workers. If the health care worker could not support the individual or lost their hold on the individual during the lift, the individual would fall and likely be injured. Additionally, work related injuries for health care workers were numerous because the health care worker would have to lift individuals in awkward positions which resulted in muscle strains and back injuries. Several devices have been invented which have been used to aid people confined to wheelchairs and unable to support themselves while walking.

U.S. Pat. No. 5,778,605 discloses a walking device that is used by a person for support within a framework of four legs. The walker disclosed in U.S. Pat. No. 5,778,605 is equipped with hard rubber footings which allow the walker to be used without squeaking on hard floors. The hard rubber footings reduce the amount of noise within a hospital or nursing home.

U.S. Pat. No. 5,556,168 discloses a wheelchair with a detachably mounted back support. The back support is adjustable which improves posture of the person confined to the wheelchair. By improving the posture of the person confined to the wheelchair, the person's back will be more properly supported and the risk of subsequent back problems is reduced.

U.S. Pat. No. Des. 322,049 discloses a three-wheeled vehicle designed to transport people who are unable to walk. The three-wheeled vehicle allows a person to be mobile while still being safe during transport. Furthermore, a three-wheeled vehicle allows a disabled person who is unable to walk to be more independent by increasing the person's mobility.

U.S. Pat. No. 5,524,971 discloses an adjustable wheelchair for disabled children. As a disabled child grows, the chair is adjustable to accommodate the child's growth. Because the wheelchair adjusts to accommodate the child's growth, the wheelchair will prevent back problems such as lordosis, scoliosis and kyphosis.

A promotional flyer by Medi-Man Rehabilitation Products Inc., of Mississauga, Ontario, Canada, discloses a personal lifting device. The lifting device includes an electric powered movable yoke with handles attached to the yoke wherein an individual is lifted from a seated position to a standing position. A harness is secured around the individual to support the individual during lifting. Additionally, a foot platform and a knee support aids in lifting the individual from a seated position to a standing position.

BRIEF SUMMARY OF THE INVENTION

The present invention is directed toward providing extension handles for a personal lifting system which is used as a walker. The extension handles comprise an extension portion and a handle portion which is substantially perpendicular to the extension portion. The extension portions are inserted into existing handles of the personal lifting system. The handle portions of the present invention are substantially perpendicular to the extension portions such that the handle portions are positioned to be used as supports while walking. The extension portion is securable at different lengths within the existing handle to provide an extension whose length can be varied. Preferably a nut and wedge frictionally secure the extension portion within the existing handle. Preferably a series of marks disposed on the extension portion allow the user to adjust the depth. The extension portion is insertable into the existing handle at various depths so that the height of the handle portions accommodate the height of the individual using the walker.

An individual seated within the personal lifting system grips the existing handles attached to the yoke of the personal lifting device. As the yoke is rotated from a horizontal position to a vertical position, the individual is raised from a seated position to an upright position. Before the individual is lifted, a foot platform of the personal lifting device is removed while the individual is lifted to a standing position the individual grips the handle portion of the extension handles of this invention. When the individual is secured and standing on the ground, the individual can use the personal lifting system as a walker. The individual grips the extension handles of the present invention and uses the handles for support while walking. The wheels provided with the personal lifting system allow the personal lifting system to be moved easily.

DETAILED DESCRIPTION

Figure 1:
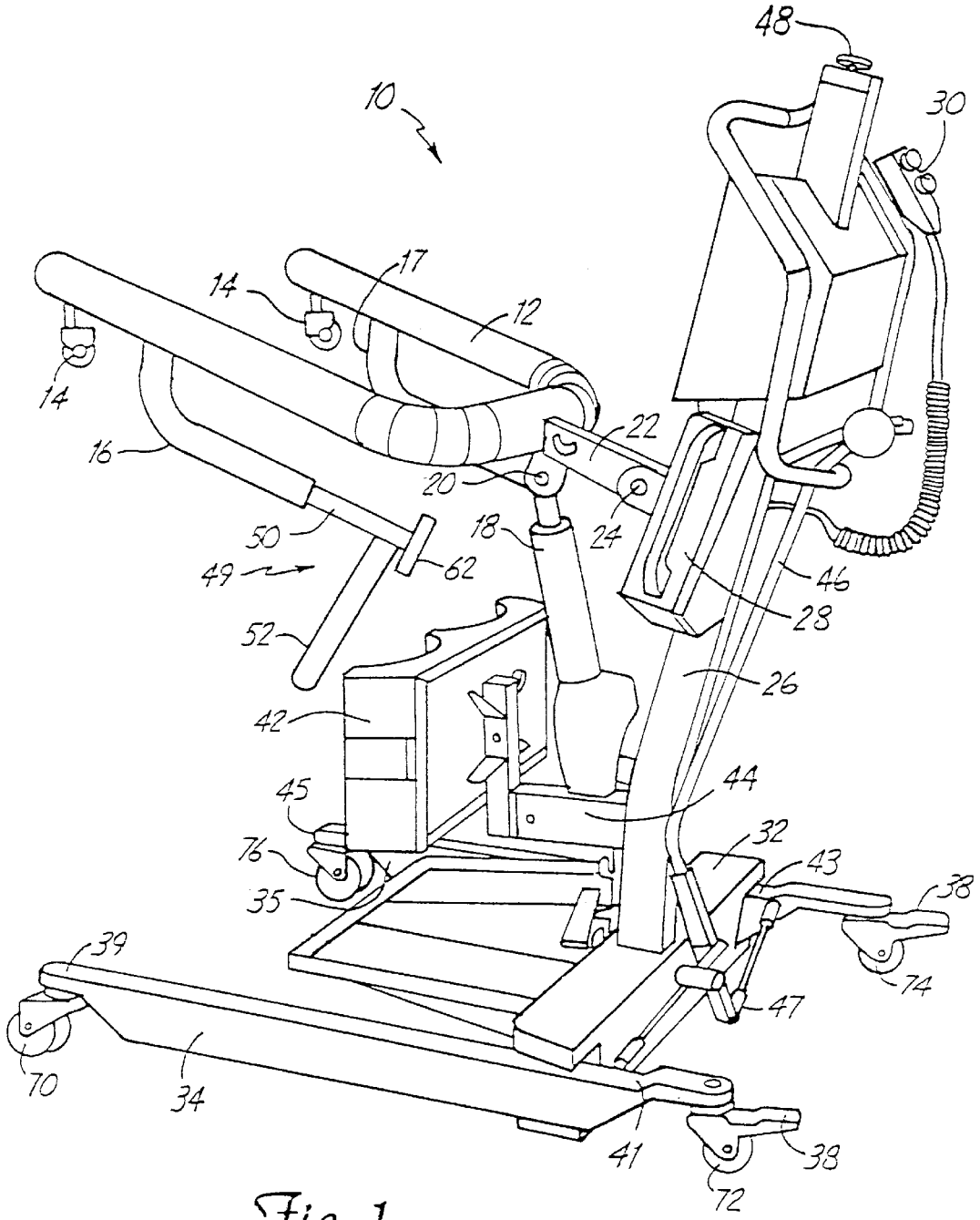
FIG. 1 is a perspective view of a personal lifting system adapted to also be used as a walker.

A combination personal lifting/walking system 10 is generally illustrated in FIG. 1. Personal lifting systems are helpful in lifting individuals who are in wheelchairs or unable to support themselves while walking. Personal lifting systems have become an aid in the health care profession and have greatly reduced worker related back strain and injuries.

Figure 4:
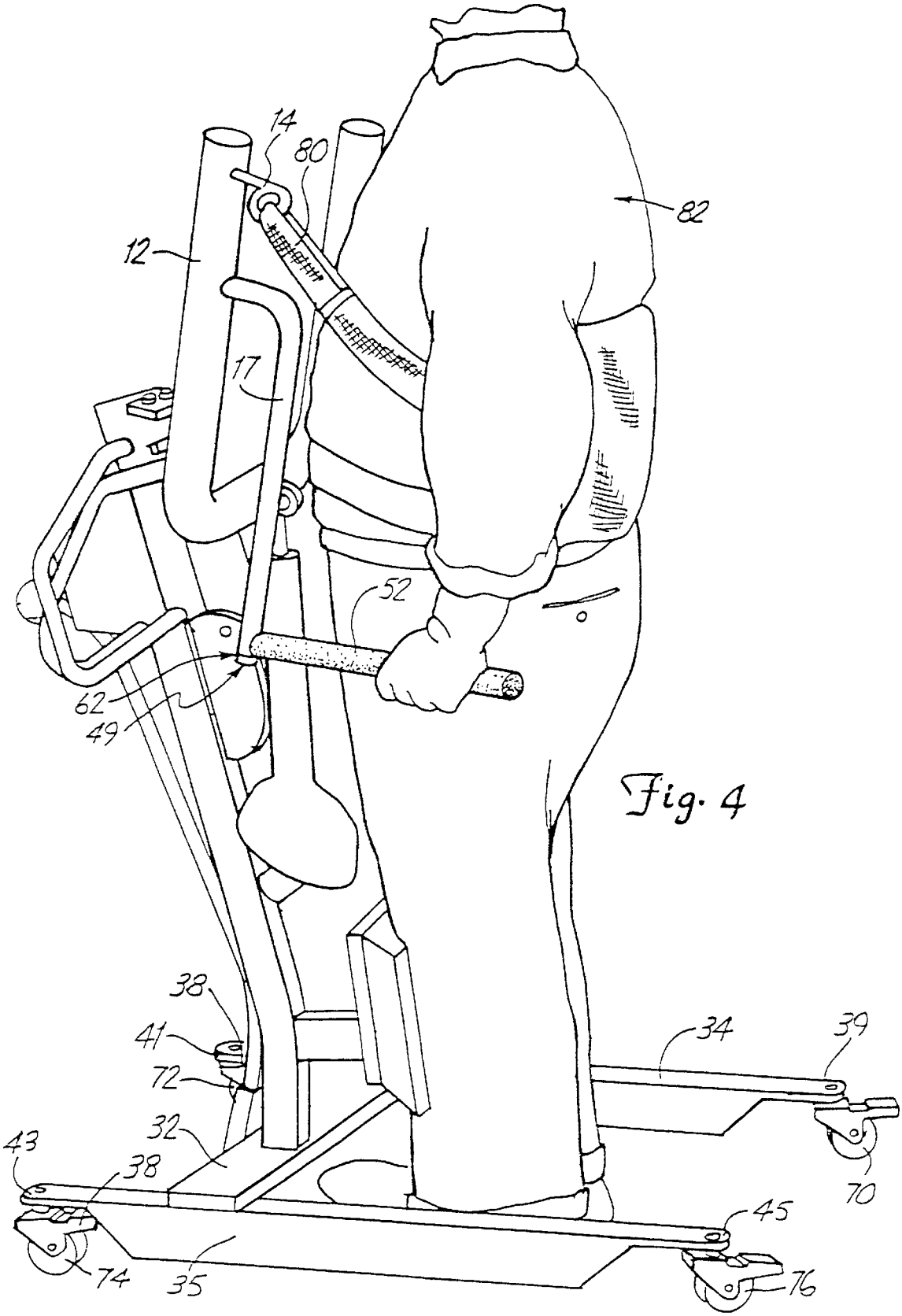
FIG. 4 is a perspective view of the present invention being used as a walker.

The present invention includes an extension handle 49 for use with the personal lifting/walking system 10. The extension handle 49 includes an extension portion 50 insertable within hollow handles 16 and 17 of the personal lifting/walking system 10. The extension handle 49 converts the system 10 into a walker as illustrated in FIG. 4.

The combination personal lifting/walking system 10 contains a movable, U-shaped yoke 12 which is attached to a lifting mechanism 18. The lifting mechanism 18 is preferably electric powered. Attached to the yoke 12 are a plurality of harness holders 14 located near the distal ends of the yoke 12. Attached to each arm of the yoke 12 are the hollow handles 16 and 17 which have end sections that extend downwardly when the yoke 12 is in an up position. The lifting mechanism 18 is attached to the yoke 12 by a pin 20.

One end of a bracket 22 is attached to a center of the yoke 12. The other end of the bracket 22 is attached to a vertical frame member 26 by a pin 24. The yoke 12 and bracket 22 rotate about the pin 24 when the yoke 12 is raised by the lifting mechanism 18.

The vertical frame member 26 is attached to a support member 32 which extends outwardly from the vertical frame member 26. Rotatably attached to the distal ends of the support member 32 are base members 34 and 35 which extend outwardly from the support member 32. The base member 34 includes a proximal end 41 to which a wheel 72 is attached and distal end 39 to which a wheel 70 is attached. The base member 35 includes a proximal end 43 to which a wheel 74 is attached and a distal end 45 to which a wheel 76 is attached.

The wheels 72 and 74 contain manual braking mechanisms 38. The manual braking mechanisms 38 prevent the personal lifting system 10 from moving while in use.

A width adjusting lever 46 controls an adjustment mechanism 47 which pivots the plurality of base members 34 about the distal ends of the support member 32. The width adjusting mechanism 47 causes the distal ends 39 and 45 of the base members 34 and 35 to move farther from each other or closer to each other to allow a wheelchair (not shown) to be brought into proximity of the personal lifting device 10.

Figure 2:
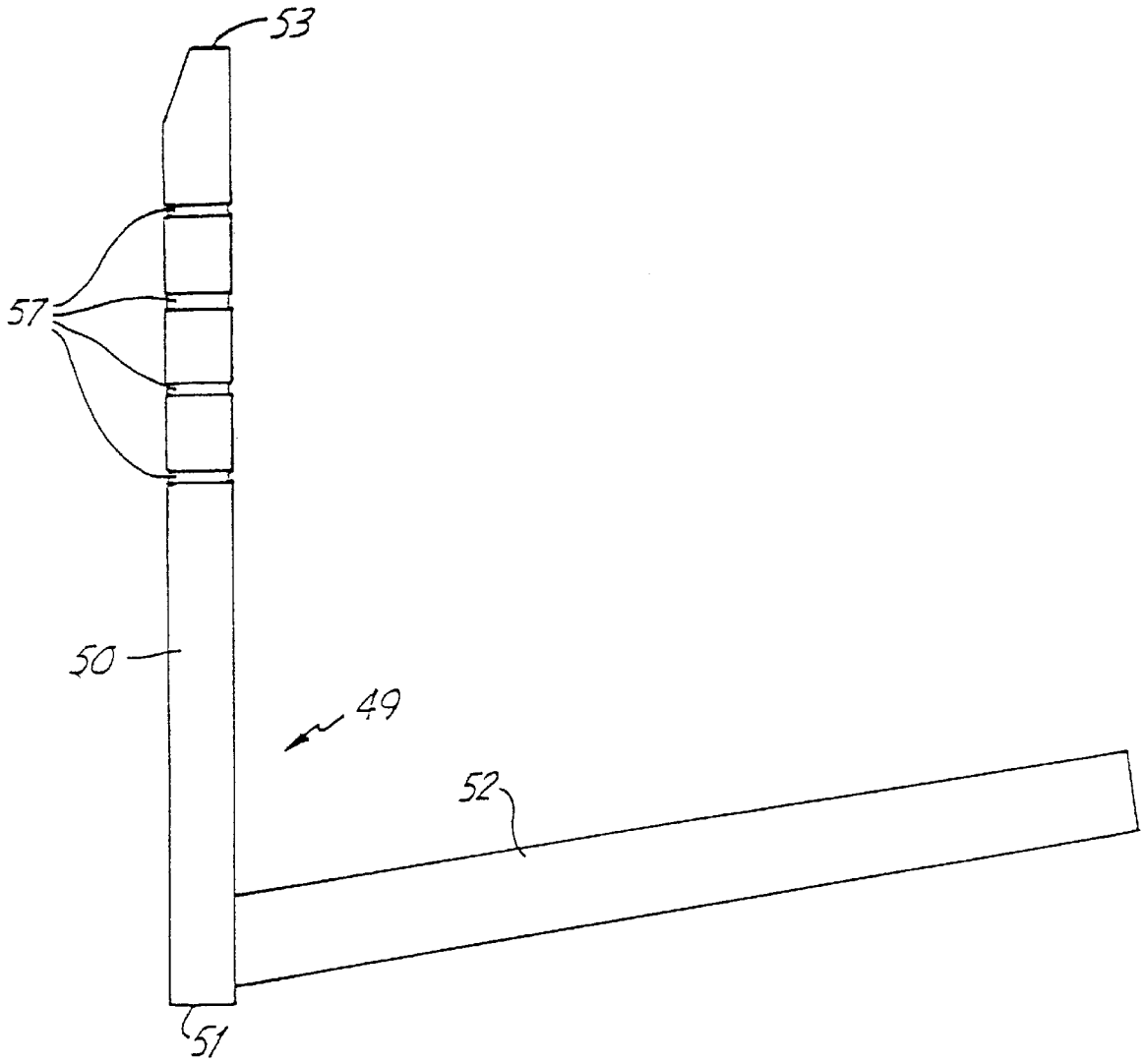
FIG. 2 is a side view of the extension handles of the present invention which are inserted into the handles of the personal lifting system.

The extension portion 50 of the extension handle 49, as illustrated in FIG. 2, is made of a tubular material, preferably stainless steel. The extension portion 50 includes a proximal end 51 and a distal end 53. The distal end 53 of the extension portion 50 has an angled surface 55 inclined at an acute angle with respect to the axis of the extension portion 50 and is therefore disposed at an angle with respect to the end 53.

A plurality of markings 57 are located on the extension portion 50 near the distal end 53 to indicate the depth which the extension portion is inserted into the handles 16 and 17. A handle portion 52 is attached to the extension portion 50 near the proximal end 51 and extends outwardly from the extension portion 50 in a substantially perpendicular manner so that the handle portion is disposed substantially horizontally when the handles 16 and 17 are disposed vertically. Preferably, the handle portion is disposed at approximately 80° with respect to the axis of the extension portion.

Figure 3:
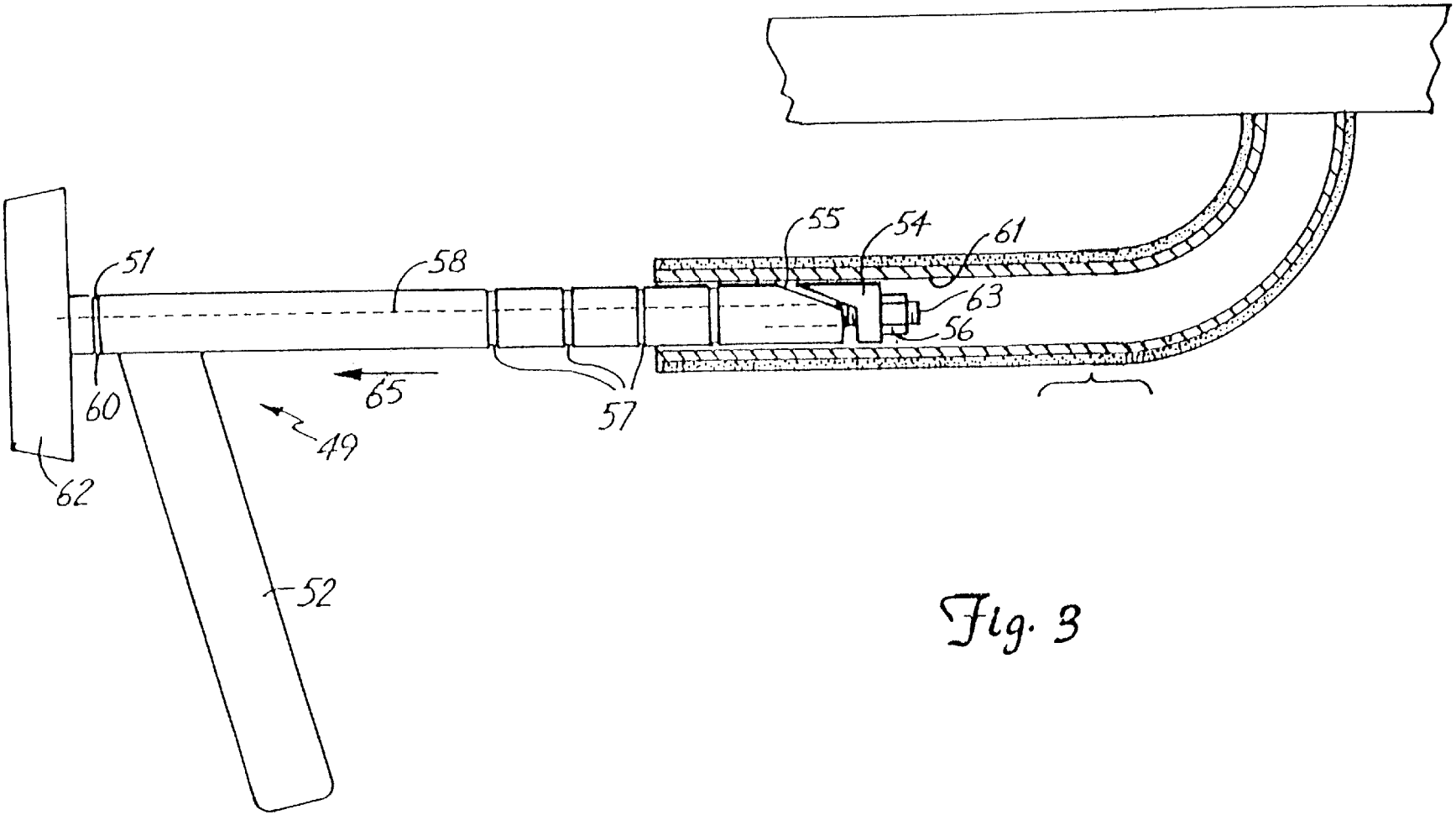
FIG. 3 is a side view of the extension handles along with the tightening device.

A rod 58 is inserted through the extension portion 50 such that a distal end 63 of the rod 58 extends past the distal end 53 of the extension portion 50 as illustrated in FIG. 3. The distal end 63 of the rod 58 is threaded. A T-nut 62 is threadably attached to the proximal end 61 threadably engaging the rod 58. The proximal end 51 of the extension 50 is separated from the T-nut 62 by a washer 60. The washer 60 prevents the T-nut 62 from binding on the proximal end 51 of the extension portion 50 when the T-nut is turned.

A wedge 54 is threadably secured to the rod 58 proximate the distal end 63 of the rod 58 beyond the distal end 53 of the extension portion 50. A nut 56 threadably engages the threads on the distal end 63 of the rod 58 and is secured in position with an adhesive. The T-nut 62 when rotated draws the rod toward the proximal end 51. As the T-nut 62 is turned, the rod is drawn in the direction of arrow 65 and the wedge 54 moves toward the proximal end 51 of the extension portion 50. As the wedge 54 moves toward the proximal end 51 of the extension portion 50, the wedge 54 slides along the angled surface 55 of the distal end 53 of the extension 50 and moves outwardly toward the interior surface of the handle 16 and 17.

The cooperation of the wedge 54 with the angled surface 55 of the distal end 53 of the extension portion 50, causes the wedge 54 and the distal end 53 of the extension portion 50 to frictionally engage the interior surface 61 of the handles 16 and 17. The frictional engagement of the wedge 54 and the distal end 53 of the extension portion 50 secures the extension handle 49 in place within the handles 16 and 17.

The plurality of markings 57 allow each extension handle 49 to be inserted at the same depth into the handles 16 and 17, thereby allowing the handle portions 52 to be set at the same height when the yoke 12 is rotated. The plurality of markings 57 are preferably color coded to aid the operator in positioning the extension handles 49.

The height of the handles 52 is adjustable to accommodate individuals of different height by turning the T-nut 62 in an opposite direction disengaging the frictional engagement of the wedge 54. The plurality of markings 57 on the extension portion 50 allow the operator (not shown) to easily adjust the depth of the extension portions 50 within the handles 16 and 17, thereby adjusting the height of the handles 52. Once the extension portions 50 are at the desired depth, the T-nut 62 is rotated to frictionally engage the wedge 54 against interior surface 61 of the handles 16 and 17.

Once the personal lifting device 10 is in position so an individual can be lifted, typically from a wheelchair, a harness 80 is strapped to and secured around the back of the individual 82 to be lifted and in turn is attached to the harness are attached to the harness holders 14 located at the distal ends of the yoke 12 as illustrated in FIG. 4. Prior to lifting the individual, the yoke 12 is in a substantially horizontal position. The individual to be lifted places his feet on the floor and grips the handles 16 and 17 which are attached to the yoke 12. An operator (not shown) of the personal lifting/walking system 10 manipulates a control mechanism 30 which activates the lifting mechanism 18 which lifts the yoke 12 which in turn lifts the individual. As the yoke 12 is lifted upward, the harness 80 and the grip of the individual on the handles 16 and 17 lift the individual upward out of the wheelchair (not shown). To give additional support to the individual, a knee rest 42 is positioned to provide support to the lower portion of the individual during the lift. The knee rest 42 is attached to the vertical frame member 26 by a bracket 44. Once the individual is in an upright position, the operator discontinues raising the yoke 12.

As the yoke 12 is raised, the handle portions 52 move to a substantially horizontal position, allowing the individual to grip the handle portions 52 for support while standing. It will be appreciated that the handle portion 52 is disposed at a slight upward incline and that by the term substantially horizontal is meant to include such an incline. In one preferred embodiment the incline is approximately 10° with respect to horizontal. With the handle portion 52 in a substantially horizontal position, the personal lifting device 10 can then be used as a walker. The handle portions 52 are used to support the weight of the person and add stability to the person while walking.

Once the individual is stabilized in an upright position, the personal lifting/walking device 10 can be used as a walker. When the personal lifting/walking system 10 is used as a walker, the manual braking mechanisms 38 on the wheels 72 and 74 are released, allowing the personal lifting device 10 to be pushed along a floor.

In the event of an emergency, an emergency stop button 48 is located at the top end of the vertical frame member 26 which stops the movement of the yoke 12. Additionally, a rechargeable battery pack 28 which is connected to the vertical frame member 26 is used to power the lifting mechanism 18.

Although the present invention has been described with reference to preferred embodiments, workers skilled in the art will recognize that changes may be made in form and detail without departing from the spirit and scope of the invention.

What is claimed is:

1. A device for use with an apparatus for lifting a person from a seated position to a standing position wherein the apparatus has at least one hollow handle extending downwardly when the person is in a standing position, the device comprising:

an extension portion for at least partial insertion within the hollow handle;

an engaging mechanism for frictionally engaging an inner surface of the hollow handle; and a handle portion extending outwardly from the extension portion.

2. The device of claim 1 wherein the extension portion includes an axis and an angled surface disposed at an acute angle with respect to the axis of the extension portion; and wherein the engaging mechanism includes a wedge element slidably engaging the angled surface of the hollow handle such that an inside surface of the extension portion is frictionally engaged.

3. The device of claim 2 wherein the engaging mechanism further includes a rod having a distal end attached to the wedge element and an opposite proximal end such that when the rod is moved towards the opposite proximal end the wedge element is slidably moved along the angled surface to frictionally engage the inside surface of the hollow handle.

4. The device of claim 3 wherein the engaging mechanism further includes a handle member threadably attached to the rod.

5. The device of claim 1 wherein the extension portion includes indicia along an outer surface thereof for indicating a selected depth at which the extension portion is insertable into the hollow handle.

6. An apparatus for use as both a walker and a patient lifting device, the apparatus comprising:

a lifting mechanism to lift the patient from a sitting position in a wheelchair to a standing position off the wheelchair;

at least one hollow handle extending from the lifting mechanism and having an end section extending downwardly when the patient is in the standing position; and a height adjustable handle mechanism including:

an extension portion inserted within the hollow handle;

an engaging mechanism that frictionally engages an inside surface of the hollow handle; and a gripping member extending outwardly from the extension portion and disposed substantially horizontally when the patient is in a standing position.

7. The apparatus of claim 1 wherein the engaging mechanism includes an angled surface on the extension portion that is disposed at an acute angle with respect to an axis of the extension portion and a wedge element sidably engaging the angled surface whereby an inside surface of the hollow handle is frictionally engaged.

8. The apparatus of claim 7 wherein the engaging mechanism further includes a rod having a distal end attached to the wedge element and an opposite proximal end such that when the rod is moved towards the opposite proximal end the wedge element is slidably moved along the angled surface to frictionally engage the inside surface of the hollow handle.

9. The apparatus of claim 7 wherein the engaging mechanism further includes a handle member threadably attached to the rod.

10. The apparatus of claim 6 wherein the extension portion includes indicia along an outer surface thereof for indicating a selected depth at which the extension portion is insertable into the hollow handle.

11. The apparatus of claim 6 and further including a pair of hollow handles extending from the lifting mechanism and a height adjustable handle mechanism engaging each of the hollow handles.

* * * * *